US006349930B1

(12) United States Patent
Krüger et al.

(10) Patent No.: US 6,349,930 B1
(45) Date of Patent: Feb. 26, 2002

(54) LIFTING SUCKER AND METHOD OF OPERATING A LIFTING SUCKER

(75) Inventors: Michael Krüger, Edingen-Neckarhausen; Bernhard Wagensommer, Gaiberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/531,339

(22) Filed: Mar. 20, 2000

(30) Foreign Application Priority Data

Mar. 19, 1999 (DE) ..... 199 12 538

(51) Int. Cl.[7] ..... B65H 3/34

(52) U.S. Cl. ..... 271/104; 271/106; 271/107; 271/108

(58) Field of Search ..... 271/104, 105, 271/106, 107, 108, 90

(56) References Cited

U.S. PATENT DOCUMENTS 4,591,140 A 5/1986 Illig et al.
5,033,730 A * 7/1991 Davies et al. ..... 271/106
5,102,113 A 4/1992 Renner et al.
5,180,156 A * 1/1993 Matsui et al. ..... 271/104 X
6,095,514 A * 8/2000 Kudo et al. ..... 271/104

FOREIGN PATENT DOCUMENTS

DE 33 07 131 C2 9/1983
DE 33 08 867 C1 8/1984
DE 40 12 778 C1 5/1991
DE 4012778 * 5/1991

* cited by examiner

*Primary Examiner*—David H. Bollinger
(74) *Attorney, Agent, or Firm*—Herbert L. Lerner; Laurence A. Greenberg; Werner H. Stemer

(57) ABSTRACT

A method of operating a lifting sucker which takes sheets off a pile, the sheets being picked up and lifted by suction, which comprises determining at least one of the physical variables characterizing the method and comparing it with an associated desired value, and initiating countermeasures if there are any deviations from the desired value; and a lifting device operated by the method.

27 Claims, 3 Drawing Sheets

LIFTING SUCKER AND METHOD OF OPERATING A LIFTING SUCKER

BACKGROUND OF THE INVENTION

Field of the Invention

The invention relates to a lifting sucker and a method of operating a lifting sucker which takes sheets off a pile, the sheets being gripped by suction and lifted, and the lifting sucker having a suction air source, a device for executing the lifting movement and a control device.

Lifting suckers of this general type are used in paper-processing machines, in particular in printing machines, for lifting sheets off piles, in order to feed the sheets to the machine. The published German Patent Document DE 40 12 778 C1 discloses a lifting sucker of the type described at the introduction hereto. With regard to this sucker, the holding force and the lifting movement are produced together by suction air. The sheet is lifted when the suction surface is covered by the sheet. In the case of such lifting suckers, adjustment to the respective paper grades which are used is necessary, the adjustment making a great deal of fingertip feel and test runs necessary. If the adjustment is not correct, the sheet may not be picked up, or double or multiple sheets may also be gripped by the lifting sucker. It is also possible for such malfunctions to occur following an adjustment carried out once, in particular when specific influencing variables change. Such influencing variables are a waviness of the paper, temperature, humidity, electrostatics or air pressure. To some extent, sheets also stick to one another, in particular at the edges.

As a countermeasure, it has previously been known to use double-sheet controls which, in the event of a fault, stop the paper run and thus bring the machine to a standstill. However, detecting a double sheet within an imbricated sheet stream presents difficulties. The previously known double-sheet controls were disposed immediately before or upline of the inlet into the machine, the result of which is that the security elements switching-on in the event of a fault have very little reaction time available to stop the process. Furthermore, in some cases, for example in the case of specific paper grades, correct operation of the double-sheet controls is not ensured. In this case, it is possible for so-called packets to be formed, i.e., for two or more sheets to stick to one another, which can ruin the machine. Even if double-sheet controls of this type are able to prevent damage to the machine, the production process is nonetheless interrupted. A further disadvantage of the heretofore known lifting suckers and the mode of operation thereof is that the functional sequence thereof is permanently predefined, and flexible adjustments and adaptation to the production sequence are not possible.

SUMMARY OF THE INVENTION

It is accordingly an object of the invention to provide a method and a device of the type mentioned at the introduction hereto so that a sheet run is automatically stabilized for different materials, in particular for different paper grades, and during other changes to the boundary conditions, and is adjusted optimally, and double sheets are prevented.

With the foregoing and other objects in view, there is provided, in accordance with one aspect of the invention, a method of operating a lifting sucker which takes sheets off a pile, the sheets being picked up and lifted by suction, which comprises determining at least one of the physical variables characterizing the method and comparing it with an associated desired value, and initiating countermeasures if there are any deviations from the desired value.

In accordance with another mode, the method of the invention includes determining a physical variable characterizing the lifting operation.

In accordance with a further mode, the method of the invention includes determining the vacuum.

In accordance with an added mode, the method of the invention includes determining the lifting force.

In accordance with an additional mode, the method of the invention includes determining the lifting time.

In accordance with yet another mode, the method of the invention includes determining the lifting acceleration.

In accordance with yet a further mode, the method of the invention includes determining the travel as a function of time.

In accordance with yet an added mode, the method of the invention includes determining the retardation energy at the upper stop of the lifting sucker.

In accordance with yet an additional mode, the method of the invention includes comparing the physical variable with an entered desired value.

In accordance with still another mode, the method of the invention includes comparing the physical variable with physical variables from preceding operations.

In accordance with still a further mode, the method of the invention includes performing a readjustment if there are deviations.

In accordance with still an added mode, the method of the invention includes breaking off and repeating the operation.

In accordance with still an additional mode, the method of the invention includes correcting the suction force.

In accordance with yet another mode, the method of the invention includes removing multiple sheets.

In accordance with yet a further mode, the method of the invention includes subjecting multiple sheets to a transverse movement.

In accordance with yet an added mode, the method of the invention includes, after a correction, controlling the sheet run so that any possible time delay is recovered.

In accordance with another aspect of the invention, there is provided a lifting sucker having a suction air source, a device for performing a lifting movement, and a control device, comprising at least one device for measuring a physical variable, the control device being constructed so as to perform a desired value comparison, and to initiate countermeasures if there are deviations.

In accordance with a further feature of the invention, the lifting sucker comprises separate devices for picking up a sheet by suction and lifting it.

In accordance with an added feature of the invention, each of the separate devices has at least one measuring device.

In accordance with an additional feature of the invention, the lifting sucker includes an electromagnetic linear drive for lifting action.

In accordance with an alternative feature of the invention, the lifting sucker includes a piezoelectric drive for lifting action.

In accordance with yet another feature of the invention, the sheet is liftable obliquely, with a forward drive component.

In accordance with yet a further feature of the invention, the lifting sucker includes a measuring system integrated into the drive.

In accordance with yet an added feature of the invention, the lifting force is determined.

In accordance with yet an additional feature of the invention, the lifting force is determinable by measuring the current.

In accordance with still another feature of the invention, the travel is determinable as a function of time.

In accordance with still a further feature of the invention, for this measurement, the drive current has a signal superimposed thereon, and the lifting sucker includes a device for separating and separately evaluating the travel-dependent changes in this signal.

In accordance with still an added feature of the invention, the lifting sucker includes devices for determining and regulating the suction force.

In accordance with still an additional feature of the invention, the lifting movement is controllable.

In accordance with another feature of the invention, the lifting sucker includes a device for removing multiple sheets.

In accordance with a concomitant feature of the invention, the sheet run is acceleratable by the control device so that a time delay is recoverable within given limits.

With regard to the method of the invention, the object thereof is achieved in that at least one of the physical variables which characterize the method is determined or registered and compared with an associated desired value and, if there are deviations from the desired value, countermeasures are initiated.

With regard to the lifting sucker of the invention, the object thereof is achieved in that at least one device for measuring a physical variable is provided, and the control device is constructed so that it performs the desired value comparison and, if there are deviations, initiates countermeasures.

The advantage of the invention is that disruptions in the sheet run are determined or registered at the earliest possible time. This applies both to a sheet not being picked up by the lifting sucker and to two or more sheets being picked up at once. By the method according to the invention and the device according to the invention, such malfunctioning is noticed immediately, and appropriate countermeasures can be initiated. It is possible to perform a correction in good time so that malfunctioning does not occur at all, or it is possible, for example, to break off the lifting operation, to correct adjustment values and to continue the paper run immediately. As a result, extensive interruptions to the machine running can be prevented, and it is even possible, by accelerating the operation of the lifting sucker, to recover any time which may have been lost and, as a result, to ensure the uninterrupted running of the following machine, for example the printing machine. Only if no correction to the sheet run can be made, for specific reasons, is the machine stopped. However, even in this case it is possible for the control to output an error signal in good time and to stop the machine gently and therefore carefully.

Both in relation to the method and in relation to the device of the invention, different physical variables can be determined or registered. It is preferable for variables to be registered or determined which characterize the lifting operation. It is also possible for the vacuum to be registered or determined, but preferably in addition to the aforementioned variables. The lifting operation is characterized by the lifting force, the lifting time, the lifting acceleration and the lifting speed. If the lifting time is used as a basis, then a known lifting force is assumed. If the lifting acceleration is registered or determined, then account has to be taken of the weight of the drive elements. Further possibilities include registering or determining the travel of the lifting sucker as a function of the time or the retardation energy of the lifting sucker at the upper stop, i.e., after the lifting movement has been performed.

The physical variables are determined or registered, compared with the desired value and readjusted. Because the determination or registration of the physical variables generally involves determining or registering the weight of the sheet picked up, relatively large deviations are always an indication of a malfunction, which must be corrected as far as possible by countermeasures. Given a relatively large deviation of the weight in the downward direction, it can be assumed that no sheet has been picked up, and given a relatively large deviation in the upward direction, this concerns the picking up of two or more sheets. As appropriate countermeasures, the operation can be repeated, the vacuum being increased, for example, in order to be able to pick up the sheet. In the case of a plurality of sheets, it is expedient to put these down again, to reduce the vacuum and then to repeat the action of picking up a sheet. It is of course also possible to strip off double and multiple sheets in any other way, in order to be able to continue the process. For this purpose, for example, a combination of an electric-motor lifting sucker with further linear drives in the forward drive direction, or the employment of curved linear drives can be provided, possibly with a device for gripping a multiple sheet, in order to produce a deliberate relative transverse movement.

For evaluating the determined or registered physical variables, they can either be compared with an entered desired value, or it is possible to compare them with the variables of preceding operations. In the case of deviations, readjustments have to be made, for example in such a manner as described hereinabove in relation to the vacuum. If such deviations are registered or determined in good time, even when they are only small deviations, readjustment can often be made without any disruption occurring. If disruption does occur, and this cannot be remedied, then the operation must be broken off and repeated. The corrections to the physical variables are generally a correction to the suction force, in order that the latter corresponds precisely to picking up one sheet by suction. Instead of breaking off the lifting operation, in the case of multiple sheets it is also possible to remove them, for example by applying the transverse movement. The latter is to be preferred in particular when multiple sheets are not caused by excessively high suction force but by the fact that the sheets stick to one another. If a correction takes any time, it is possible to control the sheet run in such a way that any possible time delay is recovered.

Account can also be taken of the aforementioned developments of the method by appropriate configurations of the lifting sucker. Developments of this type are explained explicitly hereinbelow, purely by way of example.

An expedient development of the lifting sucker provides for it to be equipped with separate devices for picking up a sheet by suction and lifting it. This permits the deliberate, independent registration and control of both operations, and therefore significantly better adaptation of the mode of operation to the desired result than is the case in the permanently predefined mode of operation of the lifting suckers of the prior art. In particular, this means that the physical variables which characterize the lifting operation can be registered better separately from those which characterize the suction operation and can be controlled. In the case of separate devices for picking up a sheet by suction and lifting it, it is expedient for each of the devices to have at least one measuring device.

A particularly advantageous construction of the lifting sucker provides for it to be equipped with an electromagnetic linear drive for lifting the sheets. A measurement system can also be integrated into this electromagnetic linear drive or any other drive. One possibility is to register or determine the lifting force, it being possible to determine this particularly well by measuring the current. Another possibility is to register or determine the travel as a function of the time, this being possible, for example, as a result of the drive current having a signal superimposed thereon, and a device for separating and separately evaluating the changes in this signal, which corresponds to the travel covered, being provided. In this regard, reference is made to the article "Miniaturantriebe mit integriertem Wegmeβsystem" (Miniature Drives with Integrated Travel Measurement system] in F & M 9/97.

Another configuration provides for the lifting sucker to be equipped with a piezoelectric drive for the lifting action. Further drives are conceivable, it being possible for the drives also to be arranged or constructed so that the sheet is lifted obliquely, i.e., with a forward drive component. It is of course then necessary for this to be taken into account in an appropriate manner in the evaluation of the measurement results.

Devices for registering and regulating the suction force can be provided on the lifting sucker. The lifting movement can also be controlled independently of the suction force. In addition, a device for removing multiple sheets can also be provided. Moreover, the lifting sucker can be formed, by the separate drive for the lifting movement, so that the sheet run can be accelerated by the control device in a manner that a time delay can be recovered within given limits.

Other features which are considered as characteristic for the invention are set forth in the appended claims.

Although the invention is illustrated and described herein as embodied in a lifting sucker and a method of operating a lifting sucker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figures 1A, 1B:
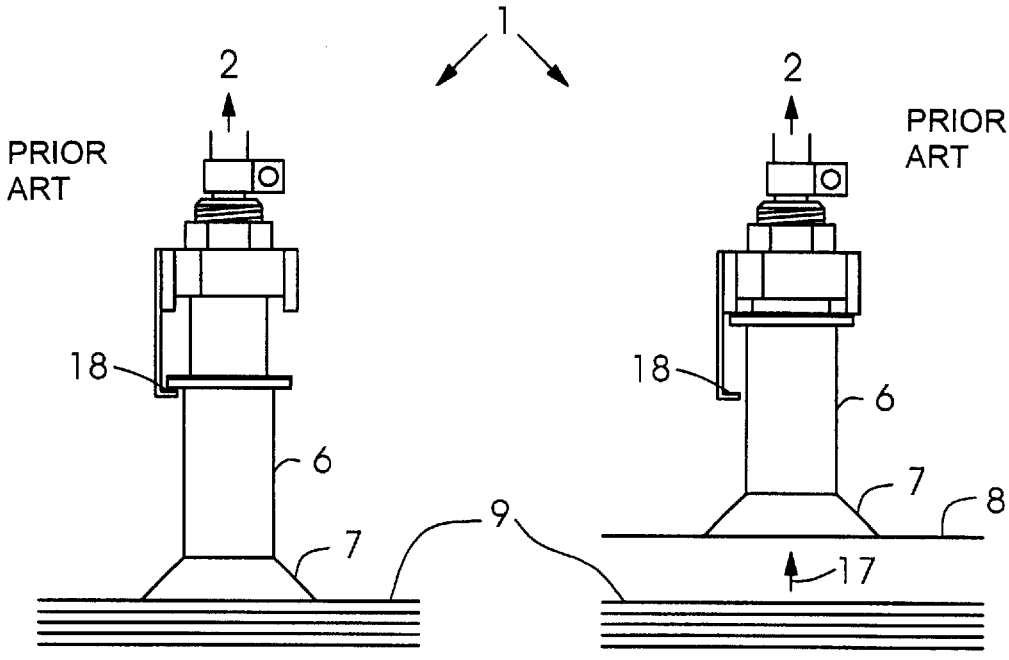
FIGS. 1*a* and 1*b* are diagrammatic front elevational views of a lifting sucker according to the prior art in different operating phases thereof showing the mode of operation thereof.

Referring now to the drawings and, first, particularly to FIGS. 1*a* and 1*b*, there is shown therein the mode of operation of a lifting sucker 1 according to the prior art. In FIG. 1*a*, the lifting sucker 1 grips a sheet 8 from a sheet pile 9 by a rubber sealing ring 7 on a suction nozzle 6. For this purpose, a vacuum or negative pressure is produced by a suction air source 2. After the sheet 8 has been gripped, a lifting movement represented by the vertical arrow 17 shown in FIG. 1*b*is executed, the suction air effecting the lifting action after the sheet 8 has been picked up by suction. In the case of a lifting sucker 1 of this type, the lifting movement in the direction of the arrow 17 is not produced if the rubber sealing ring 7 does not completely cover the sheet 8, as can be the case with wavy paper. In addition, the action of lifting double or multiple sheets cannot be registered directly on the lifting sucker 1, because an appropriately accurate determination of the weight is not possible.

Figure 2:
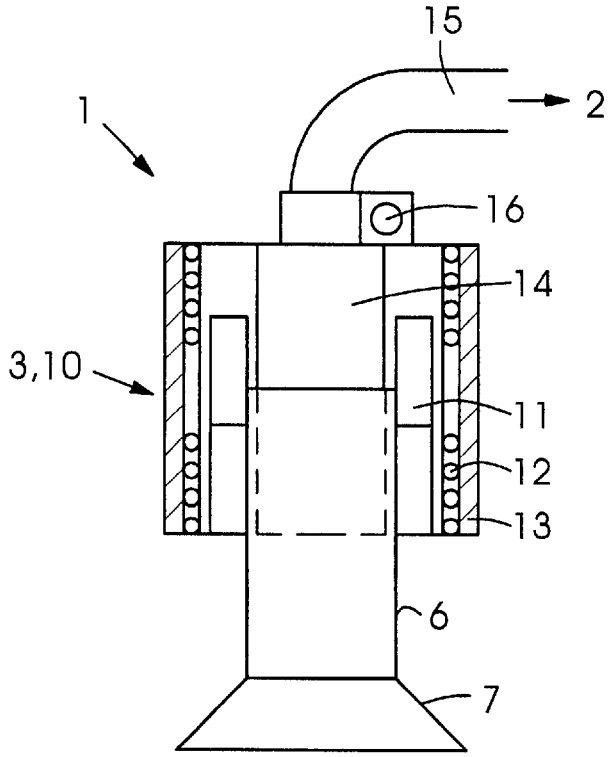
FIG. 2 is a front elevational view, partly in section, of a first exemplary embodiment of the lifting sucker according to the invention.

FIG. 2 represents a sketch of the construction principles of a first exemplary embodiment of the lifting sucker 1 according to the invention. In this embodiment, the sucking operation and the lifting operation are separate. The sucking action is likewise performed by a suction air source 2, which is connected by a hose 15 and a hose clip 16 to a nozzle guide 14, and applies the necessary vacuum to the suction nozzle 6. The device for executing the lifting movement 3 is, however, constructed separately as an electromagnetic linear drive 10 which includes a permanent magnet 11 connected to the suction nozzle 6. The lifting movement in the direction of the arrow 17 results from the permanent magnet 11 being acted upon by an appropriate force for the lifting movement at 17 via current flux in a coil 12 in conjunction with an iron feedback path 13.

The electromagnetic linear drive 10 can be used at the same time for registering the lifting force, wherein the current is measured and is used as a measure for the lifting force. It is also possible, however, to superimpose on the current for the drive a signal which changes as a result of the movement of the permanent magnet 11 and can therefore be used for determining the lifting path covered.

Figure 3:
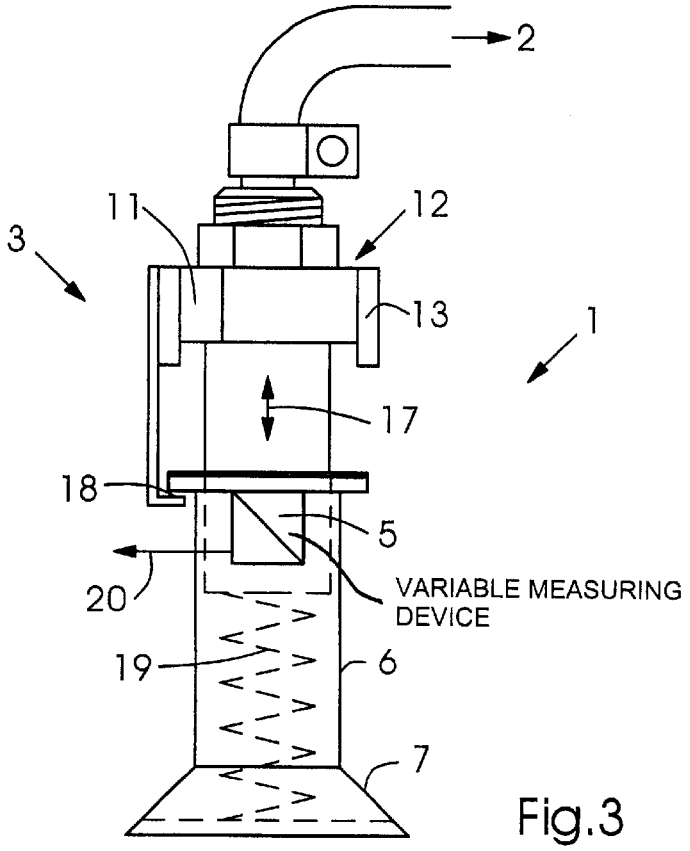
FIG. 3 is a view like that of FIG. 2 of a second exemplary embodiment of the lifting sucker according to the invention.

FIG. 3 shows a second exemplary embodiment. In this embodiment, a device 5 for measuring a physical variable is provided. The device may be one of the aforementioned measurement devices, but may also be a force or acceleration sensor. The measurement signal 20 is evaluated by being compared with a desired value, in order to initiate countermeasures. This evaluation can be performed continuously or only in specific time intervals, in order to filter out parasitic effects such as adhesive friction. For this purpose, the measurement value can also be filtered. It is also further possible for an additional non-illustrated measurement device for the vacuum to be provided. The exemplary embodiment further has a stop 18 for the lower position of the suction nozzle 6. Moreover, a spring 19 is provided, which assists the downward movement of the suction nozzle 6 caused by the weight and ensures that the lifting movement 17 is not executed by the vacuum but only by the device for executing the lifting movement 3.

Figure 4:
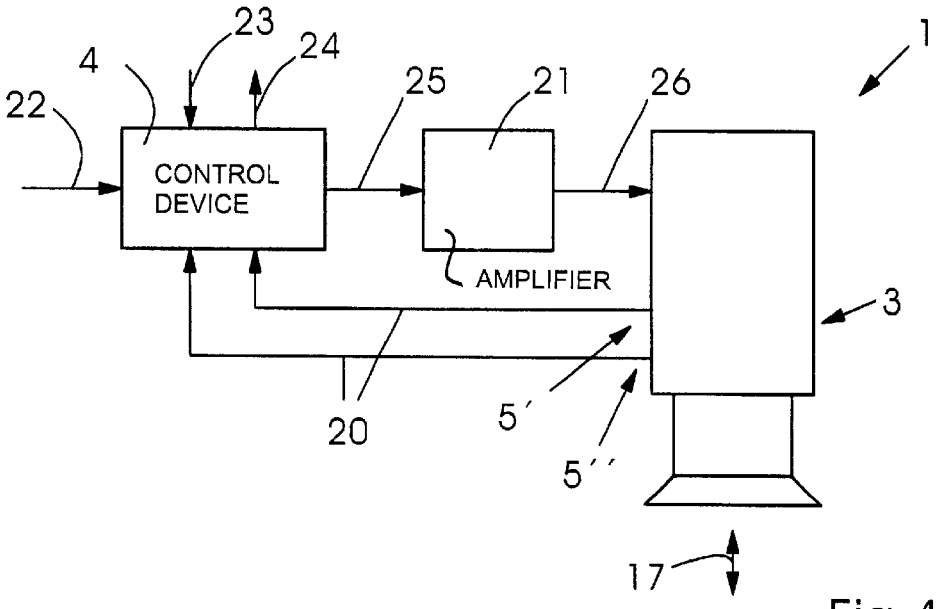
FIG. 4 is a diagrammatic and schematic view of the lifting sucker according to the invention connected with controls.

FIG. 4 shows a lifting sucker according to the invention connected with controls. On the device 3 for executing the lifting movement 17 there is, as the device 5 for measuring a physical variable, a current measuring device 5' and a voltage measuring device 5". The measurement signals 20 are fed to a control device 4, which compares the signals 20 with one or more desired values 23 or with desired values from preceding operations 22. In these desired values, many influencing variables can be taken into account, for example the type of paper, the paper format, the paper thickness or the type of sucker employed. Extreme conditions can also be taken into account, such as during the processing of pasteboard. If these desired values do not agree with the measured values, an error signal 24 is output, and corrections are made by the control current 25 and the application of suction air, for example the lifting operation represented by the arrow 17 is repeated. The control current 25 is fed to an amplifier 21, which provides the appropriate operating current 26 for the electromagnetic linear drive 10.

Figure 5:
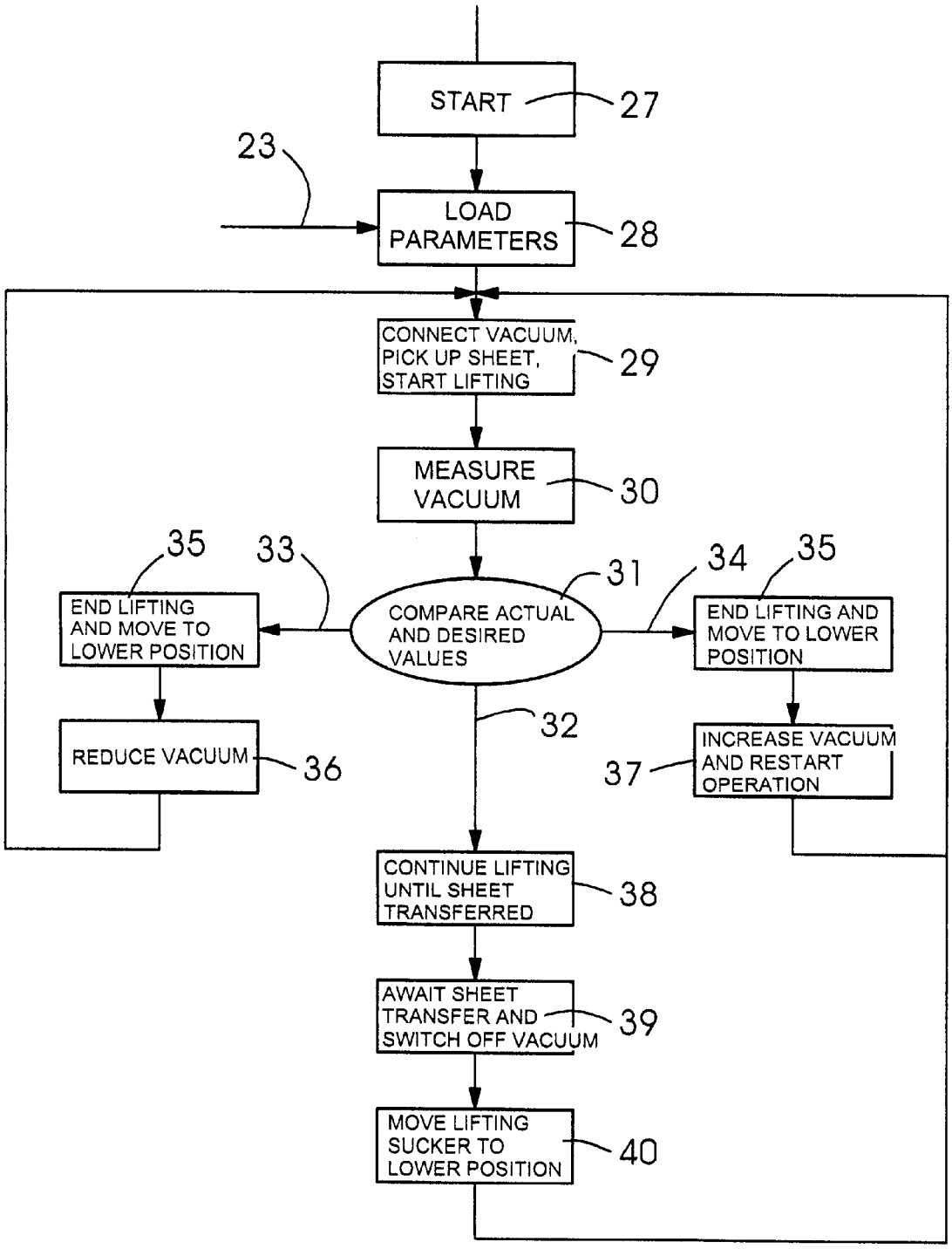
FIG. 5 is an exemplary flow diagram for performing the method according to the invention.

FIG. 5 is an exemplary flow diagram representing the method according to the invention. After the start 27, in a first step 28, the parameters are loaded, for example as the entered desired values 23 which correspond to the paper grade to be printed. With the step 29, the vacuum corresponding to these parameters is connected in, a sheet 8 is picked up by suction and the lifting operation 17 is started. After a sheet 8 has been gripped by the lifting sucker 1, a measurement 30 of the vacuum is made. This is transmitted to the control device 4, which performs an actual value/desired value comparison 31. Depending upon whether the vacuum is correct 32, too high 33 or too low 34, further corresponding operating steps are performed. If the vacuum 32 is correct, in a step 38, the lifting operation is continued until the sheet 8 is transferred, for example to a dragging sucker. In a step 39, the sheet transfer is awaited and the vacuum is then switched off. The lifting sucker 1 is then moved to the lower position, i.e., the position 40. If the vacuum is too high 33, the lifting operation is terminated and a move is made to the lower position, i.e., the position 35. The vacuum is then reduced at position 36, and the operation is repeated. If the vacuum is too low, i.e., at arrow 34, then, in a step 35, the lifting movement is likewise terminated and a move is made to the lower position. The vacuum is then increased, i.e., at the position 37, and the operation is restarted.

Both the lifting sucker and the method are only exemplary representations. Various parameters can be registered or determined in a similar way and, instead of the vacuum, it is also possible for the acceleration, speed or other parameters of the operation to be registered and controlled. A combination of various possibilities is also conceivable. Appropriate values from experience can also be stored as characteristic curves and used as a basis for controlling the operation.

We claim:

1. A method of operating a lifting sucker for taking a sheet off of a pile, which comprises:

determining at least one physical variable that characterizes an operation of lifting a sheet off of a sheet pile, the at least one physical variable defining a determined physical variable;

comparing the determined physical variable with a desired value of the physical variable to obtain an amount of a deviation of the determined physical variable from the desired value of the physical variable;

initiating countermeasures if the amount of the deviation is not acceptable; and using a lifting sucker to lift the sheet of off the sheet pile if the amount of the deviation is acceptable.

2. The method according to claim 1, wherein the step of determining at least one physical variable includes determining an amount of a vacuum applied to the sheet.

3. The method according to claim 1, wherein the step of determining at least one physical variable includes determining an amount of a lifting force applied to the sheet.

4. The method according to claim 1, wherein the step of determining at least one physical variable includes determining an amount of a lifting time necessary to lift the sheet.

5. The method according to claim 1, wherein the step of determining at least one physical variable includes determining an amount of a lifting acceleration necessary to lift the sheet.

6. The method according to claim 1, wherein the step of determining at least one physical variable includes determining an amount of a travel of the lifting sucker as a function of time.

7. The method according to claim 1, wherein the step of determining at least one physical variable includes determining a retardation energy at an upper stop of the lifting sucker.

8. The method according to claim 1, wherein the desired value is an entered value.

9. The method according to claim 1, which comprises obtaining the desired value from a physical variable characterizing a preceding lifting operation.

10. The method according to claim 1, wherein the step of initiating countermeasures includes readjusting the at least one physical variable.

11. The method according to claim 1, wherein the step of initiating countermeasures includes breaking off a lifting operation and repeating the operation.

12. The method according to claim 1, wherein the step of initiating countermeasures includes correction a suction force of the lifting sucker.

13. The method according to claim 1, which comprises removing multiple sheets.

14. The method according to claim 13, which comprises subjecting multiple sheets to a transverse movement.

15. The method according to claim 1, which comprises, after a correction, controlling a sheet run so that any possible time delay is recovered.

16. A lifting sucker, comprising:

a suction air source;

a device for performing a lifting movement;

at least one device for measuring a physical variable characterizing an operation for lifting a sheet off of a sheet pile, the physical variable defining a measured physical variable;

a control device constructed to determine a deviation between the measured physical value and a desired physical value and to initiate countermeasures if the deviation is unacceptable.

17. The lifting sucker according to claim 16, comprising a plurality of separate devices for picking up a sheet by suction and lifting it.

18. The lifting sucker according to claim 17, wherein said at least one device for measuring includes a plurality of measuring devices, each one of said plurality of said separate devices including a respective one of said plurality of said measuring devices.

19. The lifting sucker according to claim 17, including an electromagnetic linear drive for lifting action.

20. The lifting sucker according to claim 19, including a measuring system integrated into the drive.

21. The lifting sucker according to claim 17, including a piezoelectric drive for lifting action.

22. The lifting sucker according to claim 17, comprising a forward drive component for obliquely lifting the sheet.

23. The lifting sucker according to claim 16, comprising:

a current measuring device;

said device for performing the lifting movement including a permanent magnet and an electromagnetic linear drive that receives a drive current with a superimposed signal;

said current measuring device for measuring the superimposed signal so that changes of the superimposed signal caused by movement of the permanent magnet can be determined.

24. The lifting sucker according to claim 16, including devices for determining and regulating the suction force.

25. The lifting sucker according to claim 16, wherein said control device controls said device for performing the lifting movement.

26. The lifting sucker according to claim 16, including a device for removing multiple sheets.

27. The lifting sucker according to claim 16, wherein said control device is constructed to accelerate a sheet run so that a time delay is recoverable to within a predetermined value.

* * * * *